United States Patent [19]

Frias et al.

[11] 4,426,182

[45] Jan. 17, 1984

[54] TUBULAR HANDLING APPARATUS

[75] Inventors: Robert Frias, Odessa; Troy D. Cain, Fort Worth, both of Tex.

[73] Assignee: Ingram Corporation, New Orleans, La.

[21] Appl. No.: 301,928

[22] Filed: Sep. 10, 1981

Related U.S. Application Data

[63] Continuation-in-part of Ser. No. 185,726, Sep. 10, 1980, Pat. No. 4,382,738, and Ser. No. 185,727, Sep. 10, 1980, abandoned.

[51] Int. Cl.[3] ..... E21B 19/14

[52] U.S. Cl. ..... 414/22; 193/2 A; 193/17; 198/731; 280/43.24; 414/748

[58] Field of Search ..... 414/22, 745, 748; 193/2 A, 17; 198/731; 280/43.23, 43.24; 105/177, 216, 217; 24/211 N; 175/52, 85

[56] References Cited

U.S. PATENT DOCUMENTS

| | | | |
|---|---|---|---|
| 3,183,828 | 5/1965 | Clements | 280/43.23 X |
| 3,559,821 | 2/1971 | James | 414/22 |
| 3,570,694 | 3/1971 | Tantlinger | 280/43.23 X |
| 3,596,554 | 8/1971 | Low | 24/211 N X |
| 3,734,208 | 5/1973 | Otto | 414/22 X |
| 3,792,783 | 2/1974 | Brown | 414/22 |
| 4,208,158 | 6/1980 | Davies et al. | 414/22 |
| 4,211,400 | 7/1980 | Ray | 193/2 A X |
| 4,235,566 | 11/1980 | Beeman et al. | 414/22 |
| 4,347,028 | 8/1982 | Dugan | 414/22 |

*Primary Examiner*—Leslie J. Paperner

*Attorney, Agent, or Firm*—Lalos, Leeds, Keegan, Lett & Marsh

[57] ABSTRACT

An apparatus for transferring tubulars between the floor of a drilling rig and a pipe rack including an elongated main support frame adapted to be positioned in proximity to the pipe rack, a lift trough positioned longitudinally of the support frame and having one end pivotally coupled to the main support frame, whereby the lift trough can be pivoted upwardly to an inclined position, a power member connected to the lift trough for pivoting the lift trough upwardly to an inclined position relative to the main support frame and toward the drilling rig and downwardly to a generally horizontal position, and a carriage including a movable holding tray operatively connected to the lift trough for moving tubulars positioned in the lift trough along its length. An adjustable fixed trough supported on a drilling rig floor, sloping towards the lift trough and connectable with it when it is in the inclined position for transferring tubulars to the rig floor. The lift trough having a dump trough section for dumping tubulars toward the racks. Pivotal arms with a tiltable holding tray connected between them for transferring tubulars to and from the pipe racks and the dump trough. A wheel and track assembly for moving the entire apparatus to different locations on an offshore platform.

43 Claims, 32 Drawing Figures

TUBULAR HANDLING APPARATUS

This is a continuation-in-part of Ser. No. 185,726 filed Sept. 10, 1980, now U.S. Pat. No. 4,382,738, and Ser. No. 185,727 filed Sept. 10, 1980, now abandoned.

BACKGROUND OF THE INVENTION

1. Discussion of the Prior Art

This invention relates to an apparatus for handling tubular goods such as pipe, casings, collars, etc. and more particularly to an apparatus for transferring tubular goods between a drilling rig and a pipe rack.

In the prior art there are various methods and devices for lifting tubulars to and from a drilling rig floor. One of such methods simply attaches a wire cable to the pipe and then the cable is lifted by a hydraulic winch which is typically mounted on a truck parked near the rig. Cranes have also been used to lift the pipe. Hydraulic driven chains have been successfully used too. Pipe transferred by these methods can be dropped on personnel or equipment below causing severe injury and damage inasmuch as they can weigh thousands of pounds. Often the pipe must be lifted to heights of forty feet or more. These dangers are more intense when the apparatus and rig are positioned offshore and subjected to wave, tidal and wind forces. If the pipe is dropped or banged against other structure the threaded ends can be easily damaged or the pipe bent.

Inclined troughs for the transfer of tubulars have also been used wherein the tubular is frictionally slid along the trough surface. This action often causes excessive wear on pipe especially the threaded ends which must be protected from such wear. It was thus often necessary to keep the metal thread protector on as the pipe was moved along the trough for removal when the pipe was on the drilling rig platform. This necessary care of the threads and pipe ends creates an extra step in the installation of the pipe or other tubular in the hole resulting in a longer cycle time.

Prior art troughs sometimes were designed to pivot from a generally horizontal position adjacent the pipe rack to an inclined position near the drilling rig floor. However, no satisfactory means had been developed for supporting the uppermost end on the floor. Also, the pivoted trough lifting mechanism and the structural integrity of the trough limited the length of the trough, the angle of inclination and hence the ultimate lifting height. When the prior art transferring apparatus was used on offshore rigs, the wind, tidal and wave forces would act against the pivoting trough causing it to sway or to become out of alignment with the support means.

From a single drilling rig often 20 or more holes are bored. This requires that the tubular handling apparatus be moved around on the platform to position it near the hole being used. This is a time-consuming process and typically requires the use of additional moving equipment, e.g. cranes.

To transfer the pipe from the ground onto the prior art pipe handling apparatus also required at least two personnel manually to move or roll the pipe to the machine, a procedure that limits the pipe from being efficiently stacked. Space being at a premium on any offshore rig, the inability efficiently to stack the pipe presents a serious problem. Inclined conveyor systems had been used to handle tubulars in the past but they occupied such large amounts of valuable floor space that they are not in any substantial use today.

OBJECTS OF THE INVENTION

Accordingly, it is the principal object of the present invention to provide an improved apparatus for transferring tubular goods between a pipe rack and the floor of a drilling rig.

Another object of the present invention is to provide an improved tubular handling apparatus which can be used effectively and safely under varying weather conditions on offshore units with tubulars of various diameters and lengths.

A further object of the present invention is to provide a tubular handling apparatus that has an automatic pipe feeder to attain a pipe transferring cycle time shorter than that of the drilling crew.

A further object is to provide an improved pipe handling apparatus that can be easily moved to different locations on a drilling rig.

A still further object is to provide a pipe handling apparatus that can transfer pipe from racks on one side of the apparatus to the other side without necessitating the use of additional equipment, e.g. a crane.

Another object is to provide an apparatus that can handle pipe without damaging the pin ends thereof and that does not require that protective caps remain or be placed on the pipe ends.

Other objects and advantages of the present invention will become more apparent to those persons having ordinary skill in the art to which the present invention pertains from the following description taken in conjunction with the accompanying drawings.

THE DRAWINGS

DESCRIPTION OF THE INVENTION

General Description

Figure 1:
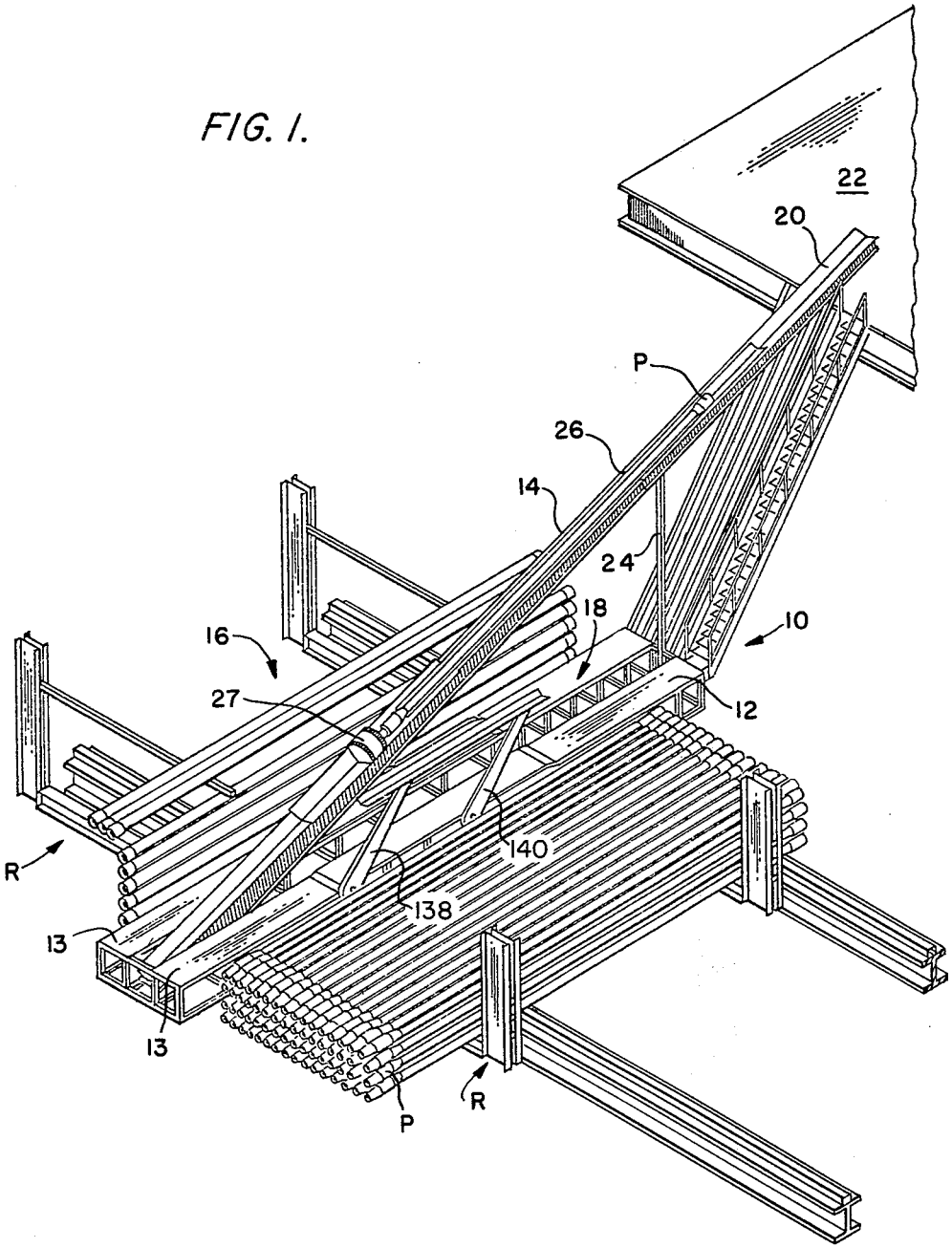
FIG. 1 is a perspective view partly broken away of an apparatus embodying the present invention in use at a drilling rig site.

Referring to FIGS. 1 through 4, there is illustrated the apparatus of the present invention shown generally at 10 for handling pipe P and other tubulars. This apparatus generally includes a main support frame 12 shown positioned on the ground or, in its preferred use, on an offshore rig. The apparatus also includes left and right catwalks 13, 13 for utility use, a lift or pivoted trough 14 pivotally connected to frame 12, pipe transferring assemblies 16 and 18 positioned on opposite sides of frame 12 adjacent tandem pipe racks R and lift trough 14 and positioned at approximate midsections thereof, a fixed trough 20 supported at one end by drilling rig floor 22 and at the other end by fixed trough support 24, a locking means 26, for connecting lift trough 14 to fixed trough 20 and a pipe carriage assembly 27 for moving the pipe up or down the troughs. Thus, apparatus 10 transfers pipe P between pipe racks R on either side of the apparatus 10 through the use of pipe transferring assemblies 16 and 18 which raise the lower the pipe P to and from the lift trough 14 that may be selectively lifted or lowered as desired to the fixed trough 20. The carriage assembly 26 moves the pipe along the troughs to the floor 22 of the drilling rig.

Detailed Description of the Invention

Figures 2, 12:
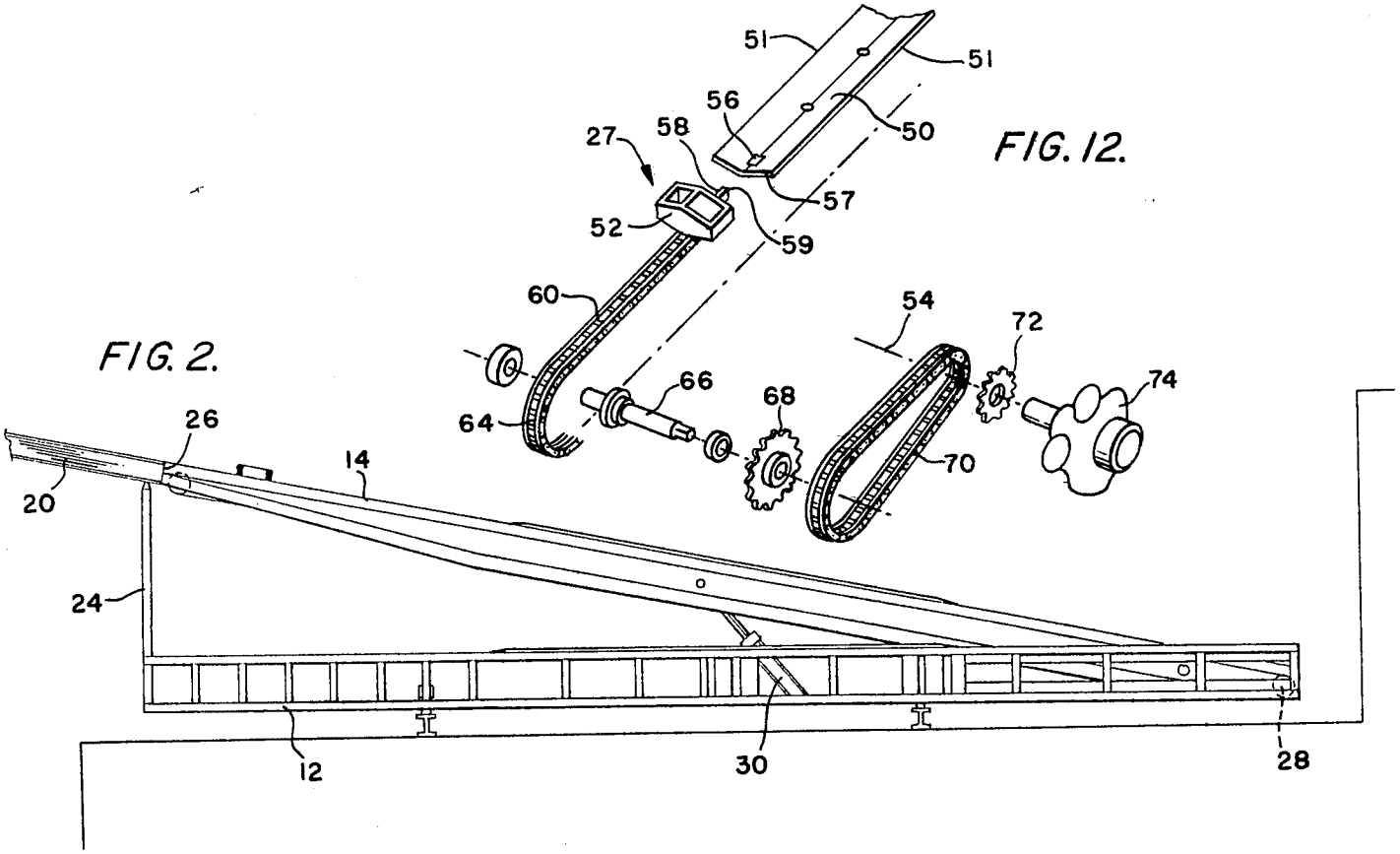
FIG. 2 is a side elevational view partly broken away of the apparatus of FIG. 1 showing the lift trough in a fully inclined position.
FIG. 12 is a perspective view of the apron and carriage means of FIG. 9 illustrating the components thereof in exploded relation.
Figure 3:
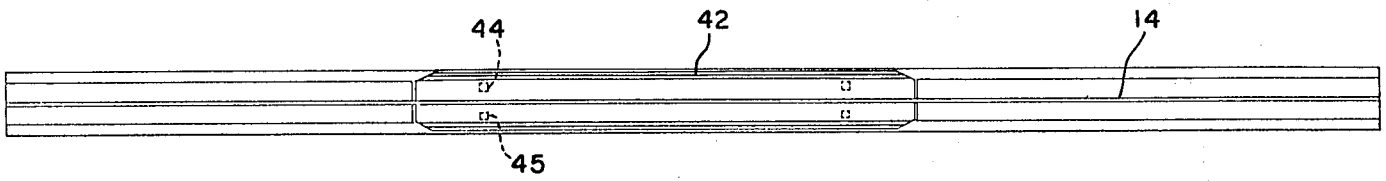
FIG. 3 is a top plan view of the lift or pivoted trough of FIG. 1.
Figure 4:
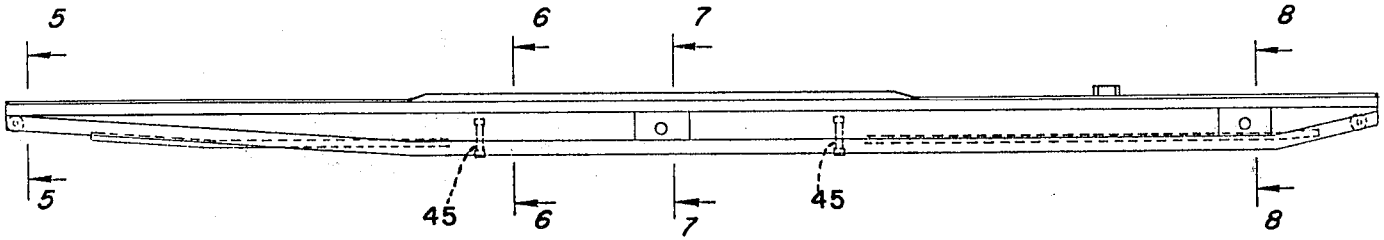
FIG. 4 is a side elevational view of the lift or pivoted trough of FIG. 3.
Figure 5:
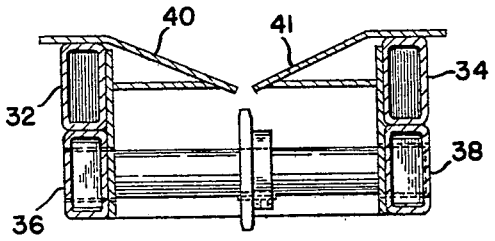
FIG. 5 is a cross-sectional view taken along line 5—5 in FIG. 4.
Figure 20:
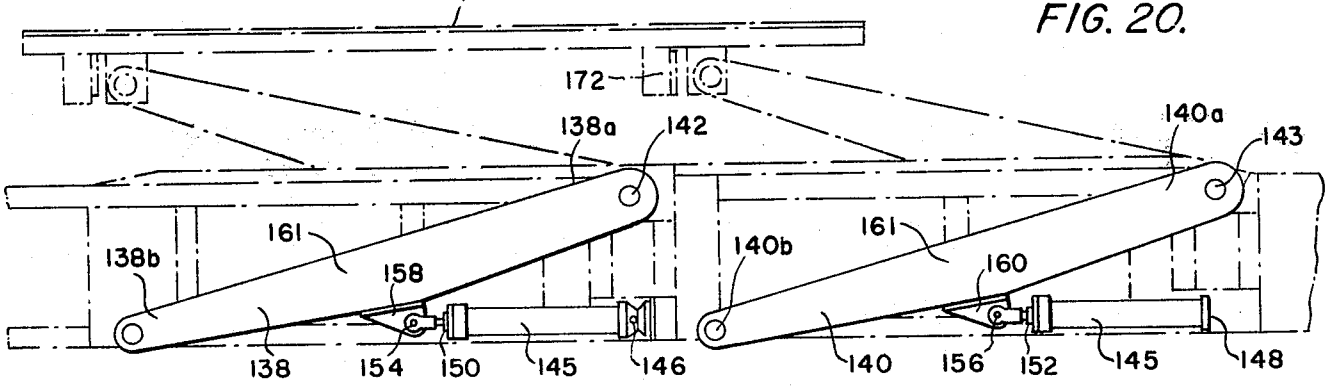
FIG. 20 is a side elevational view partly broken away of the pipe stacker assembly arms at the lowered position of FIG. 1 and with the raised position and other structure shown in phantom lines.
Figure 22:
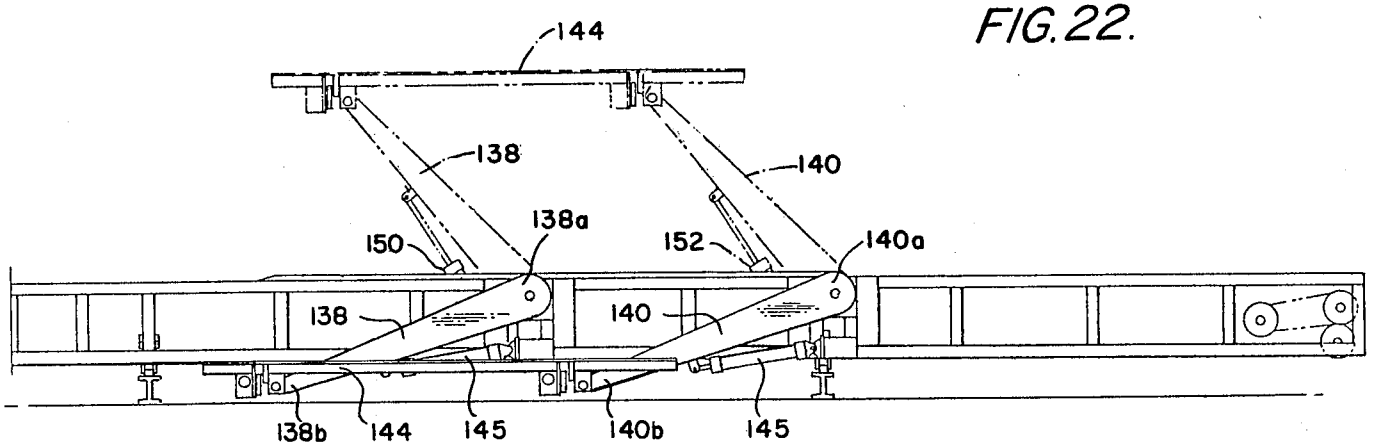
FIG. 22 is a view similar to FIG. 20 illustrating a variation thereof and illustrating the raised position in phantom lines.
Figure 24:
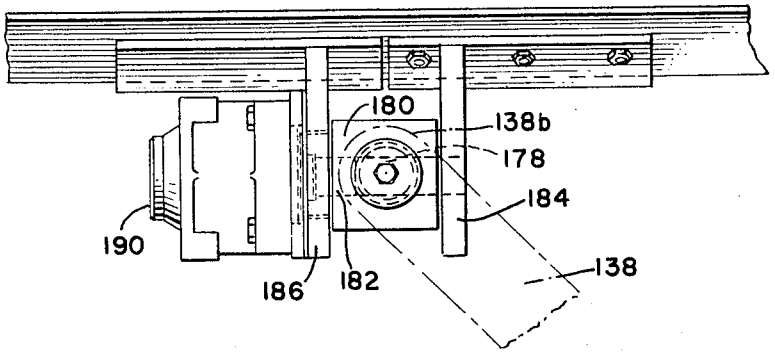
FIG. 24 is a side elevational view of the tilting mechanism and stacker tray in FIG. 23 with the arm shown in phantom lines.
Figure 26:
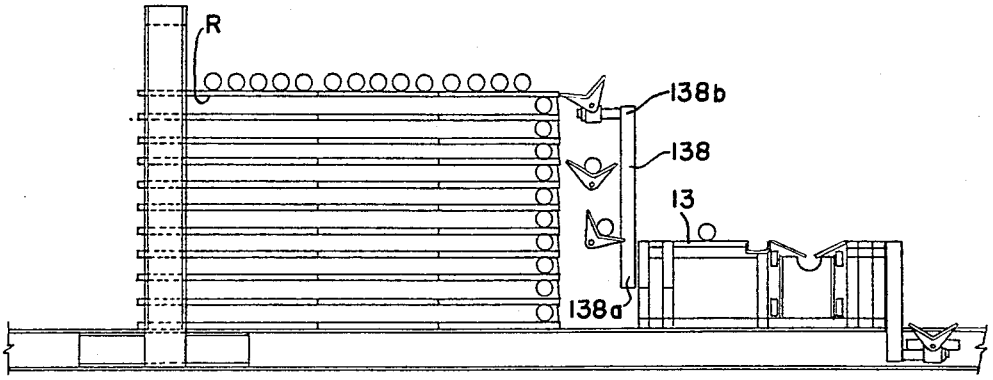
FIG. 26 is an end elevational view partly broken away of the pipe transfer system of FIGS. 20 and 22 illustrating the stacker tray in different elevations and positions and the pipes in stacked positions.

As best shown in FIGS. 1 and 2, lift or pivoted trough 14 is positionable between catwalks 13, 13 and is pivotally connected by pin assembly 28 at a rearward end of elongated main support frame 12. At least one hydraulic cylinder assembly 30 is positioned rearward of the midsection of lift trough 14 and pivotally connected to the lift trough at one end and to the main support frame at the other end to lift the lift trough 14 from a generally horizontal position as shown in FIGS. 20, 22 and 26 to an inclined position as shown in FIGS. 1–4 in which it can connect with fixed trough 20.

Figure 6:
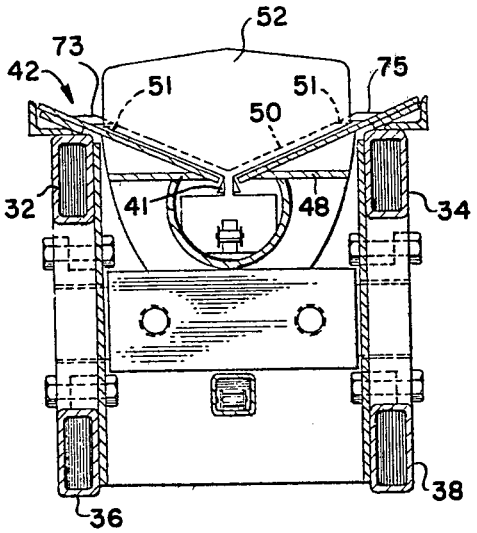
FIG. 6 is a cross-sectional view taken along line 6—6 in FIG. 4.
Figure 7:
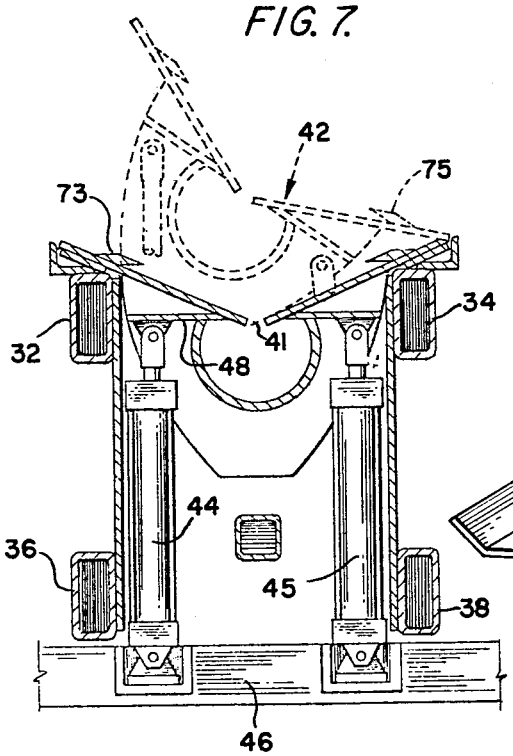
FIG. 7 is a cross-sectional view taken along line 7—7 in FIG. 4.
Figure 25:
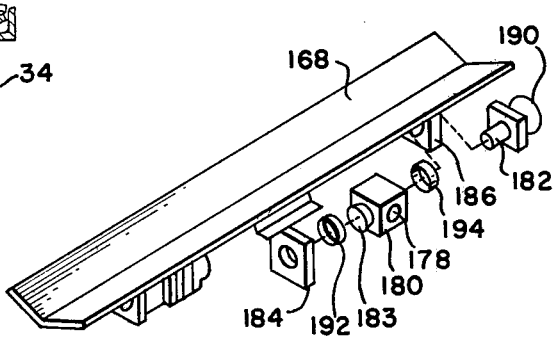
FIG. 25 is a perspective view of the stacker tray of FIGS. 20 and 22 illustrating the parts thereof in exploded relation.
Figure 8:
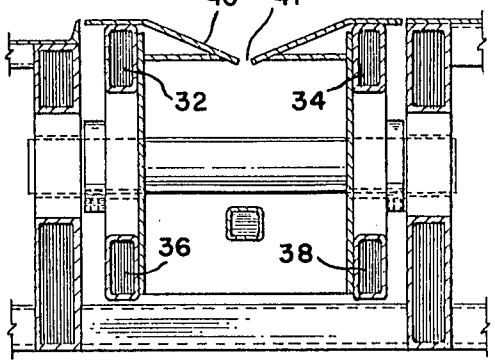
FIG. 8 is a cross-sectional view taken along line 8—8 in FIG. 4.
Figure 11:
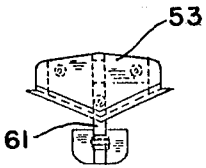
FIG. 11 is an end elevational view of a portion of the carriage means of FIGS. 9 and 10.
Figure 9:
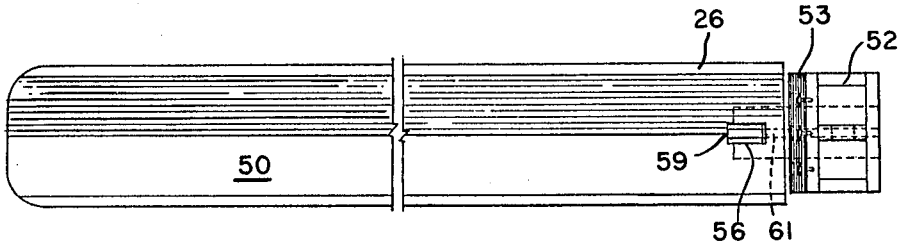
FIG. 9 is a top plan view of a slidable apron or holding trough attachable to the carriage means of the tubular handling apparatus of the present invention as shown in FIG. 1.

As best shown in FIGS. 3–8, lift trough 14 comprises horizontally and vertically spaced elongated outer frame members 32, 34, 36 and 38 which support a V-shaped steel based floor 40 along whch the pipe P slides. The V-shape defines slot 41 formed in the middle throughout the length of the lift trough 14. Intermediate the ends of the lift trough and forming a portion thereof is a dump trough 42 tiltable laterally in either direction when lift trough 14 is in a down or generally horizontal position, to dump pipe or accept pipe from the pipe transferring assemblies 16 and 18 on either side of the main frame to or from the pipe racks R. Dump trough 42 is tiltable by hydraulic cylinders 44 and 45 as best shown in FIG. 7. Cylinders 44 and 45 are positioned inside of frame members 32, 34, 36 and 38 and have their lower ends pivotally coupled at one end to cross member 46 forming the base of lift trough 14 along with elongated outer frame members 36 and 38 and at the other end pivotally coupled to base support plate 48 of the dump trough 42. As shown in FIG. 7, in phantom lines, dump trough 42 is tilting laterally to the right due to the extension of cylinder 44. The reverse tilt would be achieved by extension of cylinder 45. As is clear from the description, cylinders 44 and 45 move up and down with lift trough 14 as it is raised or lowered.

The present invention further provides for a carriage assembly 27 to move pipe P or other tubulars along the lift trough 14 and also out beyond the fixed trough 20. As best shown in FIGS. 6 and 9–12 this assembly includes an apron or movable holding trough supported for sliding movement along floor 40 of lift trough 14. Apron 50 is preferably of such dimension that it can support the entire length of pipe P so that neither of the ends of the pipe are forced to slide along the trough thereby causing damage to the pipe ends or to the trough.

The carriage assembly includes a carriage 52 releasably secured to apron 50 for movement by the power transmission assembly shown generally at 54 of FIG. 12. The apron 50 is provided with an aperture 56 formed close to the rear end 57 of apron 50 into which is fitted a tooth shaped securing member 58 which projects upwardly as a forwardly extending neck 60 of carriage 52. Aperture 56 does not extend all of the way to the rear end of apron 50 but is spaced therefrom a distance comparable to the length of neck 60. The projection of tooth member 58 slants downwardly toward its forward or leading end 59 whereby tooth member 58 may be inserted into aperture 56 while apron 50 is held stationary. To secure the apron to the carriage, rear end 57 of apron 50 when moved toward the carriage rides upwardly on tooth member 58 until it reaches the full length of aperture 56 at which time the apron will drop down and lock onto the carriage. When the carriage 52 is connected with the apron 50 by the tooth member 58, both are moved forwardly by the endless chain 60 as shown in FIG. 12.

Figure 10:
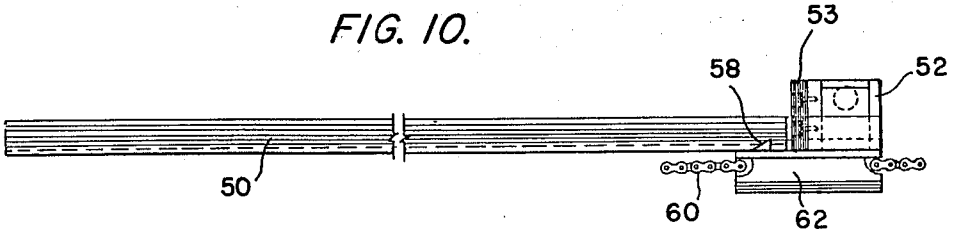
FIG. 10 is a side elevational view partly broken away of the apron or holding trough and carriage means of FIG. 9.

The carriage assembly 27 includes main drive endless chain 60 which attaches to tooth member 58 by attaching block 62 as best shown in FIG. 10. Chain 60 is driven by sprocket 64 which is secured to one end of shaft 66 as shown in FIG. 12 and connected to lift trough 14. Shaft 66 is rotated at its other end by a second sprocket 68 which is in turn rotated by a second endless drive chain 70. Chain 70 is driven by motor sprocket 72 which is rotated by a suitable hydraulic motor 74 mounted on the base of the lift trough 14.

For transferring pipe or other tubulars between the rig platform to the pipe rack, apron 50 will be moved onto fixed trough 20 by carriage assembly 27. A length of pipe P will be loaded onto apron 50 and contact the slightly resilient back plate 53 of carriage 52. The apron with the pipe and the carriage will be moved downwardly by chain 60 and the action of motor 74.

Dump trough 42 has two elongated apron holding strips 73 and 75, as best shown in FIGS. 6 and 7, formed along its outer edges so that when the apron 50 is pulled onto the dump trough 42 the side edges 51 of the apron slide under strips 73 and 75 whereby the apron is fixed with respect to lateral movement to dump trough 42. Thus when lift trough 14 is lowered to a horizontal position and dump trough 42 is tilted laterally, apron 50 will also be tilted laterally allowing pipe P to be dumped onto catwalks 13, 13 for loading onto the pipe racks R. To be in dumping position, securing tooth member 58 and carriage 52 must move just beyond the dump trough 42 into the lower non-tilting portion of the lift trough. Only the apron 52 will then be above dump trough and held by the strips 73 and 75.

When apron 50 is tilted laterally during dumping, aperture 56 is moved above tooth member 58. However, when the apron is moved back in place by the dump trough, aperture 56 will fit back around tooth member 58 whereby the carriage 52 may push apron 50 with pipe P along lift trough 14 to fixed trough 20 where pipe P may be picked up by the usual crane, not shown, on the floor 22 of the drilling rig and placed again on apron 50 to begin another cycle to restack the pipe.

In use similar to that of apron 50 transferring pipe from the rig floor 22 for loading on the pipe rack R, it is to be understood that the apron can obviously be used for moving pipe in the opposite direction, from the rack to the derrick floor to form the drill string. Apron 50 also has advantages in that it protects lift trough 14 and fixed trough 20 from wear, to which end, grease or other friction reducing material may be coated to the underside of apron 50.

When the height differential between drilling rig floor 22 and support frame 12 is sufficient such that the pipe will slide down troughs 14 and 20 by gravity, the apron 50 may be removed as well as the securing tooth member 58. In order to permit such demounting, tooth member 58 may be removably secured to the forward extension of the neck of carriage 52 by bolts or equivalent means.

Instead of employing the strips 73 and 75 to hold apron 50 to the dump trough 42, the apron may have a thin neck of a length and depth similar to neck 61 extending down from and secured to its bottom with an enlarged removably secured lug of width greater than slot 41 attached to the thin neck. The thin neck will extend through slot 41 with the enlarged lug located below floor 40. This arrangement allows apron 50 to slide on floor 40 yet holds apron 50 to the dump trough when it is tilted for dumping purposes. In this embodiment, apron 50 may be coupled to carriage 52 by securing tooth member 58 to the forward extension of neck 61 of carriage 52 through aperture 56 of apron 50 when the aperture of the apron is over the forward extension of the neck. The apron may be removed by removing tooth member 58 and by sliding the apron forward when the lift trough is at a slightly inclined position to remove the lower thin neck of the apron from slot 41 at the forward end of the trough.

Apron 50 is of such dimensions, as earlier mentioned, to be longer than even the longest tubulars. When short pipes are to be transferred it is desirable to provide an effectively shorter apron so that the pipe need not slide as far when being transferred from the rig floor to the apron and that the pipe will be more nearly centered on the dump trough when the carriage reaches its lowest position, and further that the pipe will still extend or project freely out beyond the end of the fixed trough into the drilling rig for easier pick up by the usual crane on rig platform.

Figure 13:
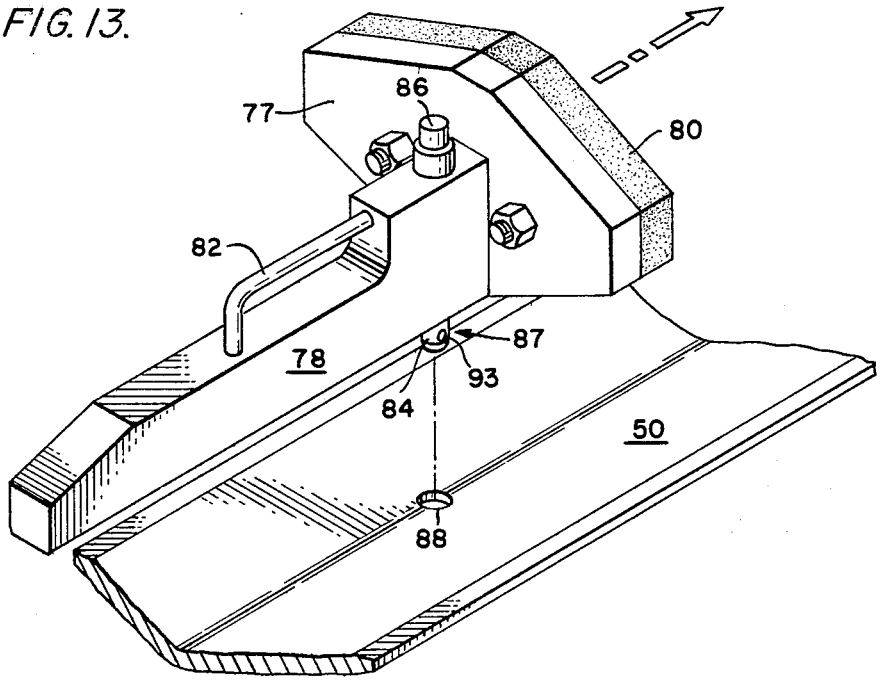
FIG. 13 is a perspective view partly broken away of the length projection or adjustment device for the apron of FIG. 9.
Figure 15:
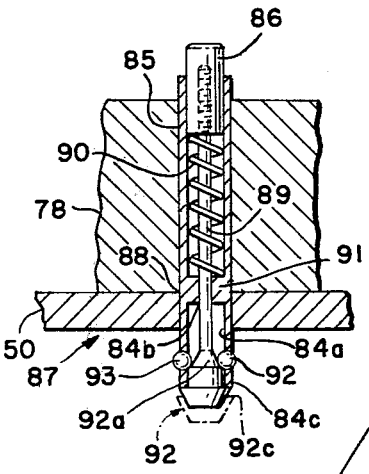
FIG. 15 is a cross-sectional view partly broken away taken along line 15—15 of FIG. 14.
Figure 14:
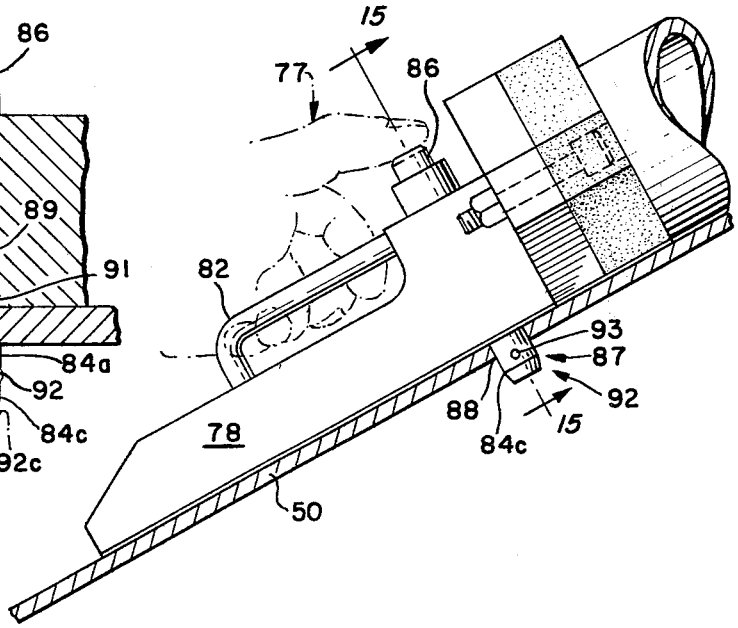
FIG. 14 is a side elevational view partly broken away of the device of FIG. 13 illustrating the operation thereof.
Figure 16:
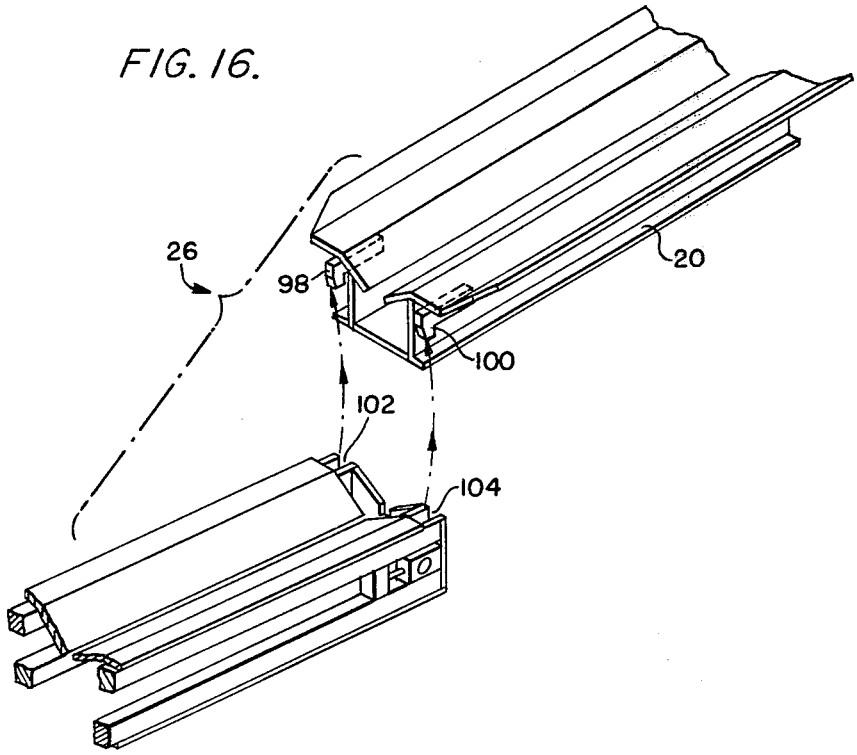
FIG. 16 is a perspective view partly broken away of the connectable ends of the lift or pivoted and fixed troughs of FIG. 1.

The present invention as best shown in FIGS. 13–15 illustrates at 77 structure to control the length of the projection of the pipe from the end of the apron 50. This length projector or positionable carriage 77 includes a body section 78, a front or working face 80 against which the pipes will rest, a handle 82 secured to the body 78, a tubular, open-ended protruding member 84, a button 86 mounted in bore 85 provided in body 78 slidably received within the tubular protruding member 84 referred to generally as an engagement mechanism 87.

Apron 50 is provided with a series of spaced positioning holes 88 through which protruding member 84 may be received. Positionable carriage 77 is designed, as best shown in FIG. 14, that it may be held and moved by hand and while the operator is grasping handle 82 he may depress button 86. When button 86 is depressed, engagement mechanism 87 is operated to release protruding member 84 which then may be withdrawn from one hole and placed in a more desirable hole. When it is placed in the desired hole 88 and button 86 is released the mechanism positioned on the underneath side of the apron is activated thereby securing the positionable carriage to the apron at the desired location. FIG. 15 best illustrates the details of the engagement mechanism 87.

The protruding member 84 is provided with a central bore **84*a* and with a sliding bore 84*b* to slidably receive rod 89 secured to the button 86 and which extends the length of the protruding member 84. A spring 90 abuts ledge 91 in which sliding bore 84***b* is formed to surround rod 89 and bias button 86 upwardly. Secured to the end of the rod remote from the button 86 is an enlarged head 92 having an upper conical portion 92*a*, a cylindrical portion 92*b* for controlled sliding engagement within bore 84*a* and an enlarged lip 92*c* which abuts the bottom edge 84*c* and limits the upward movement of the protruding member 84. As shown the protruding member 84 is provided with a plurality of ports 84 and into which ball detents 93 are positioned and sized to partially extend outwardly of the protruding member 84 but yet be retained within the bore of the protruding member.

In use, depressing the button 86 permits the balls 93 to be retracted on the conical surface 92*a* and the positionable carriage may be inserted into the bore 85. Release of the button, forces the ball detents outwardly by the action of the conical surface 92*a*. The balls thus extended have a larger diameter than the holes 88 of the apron 50 to releasably lock the positionable carriage 77 to the apron 50 at the selected hole 88.

Figure 17:
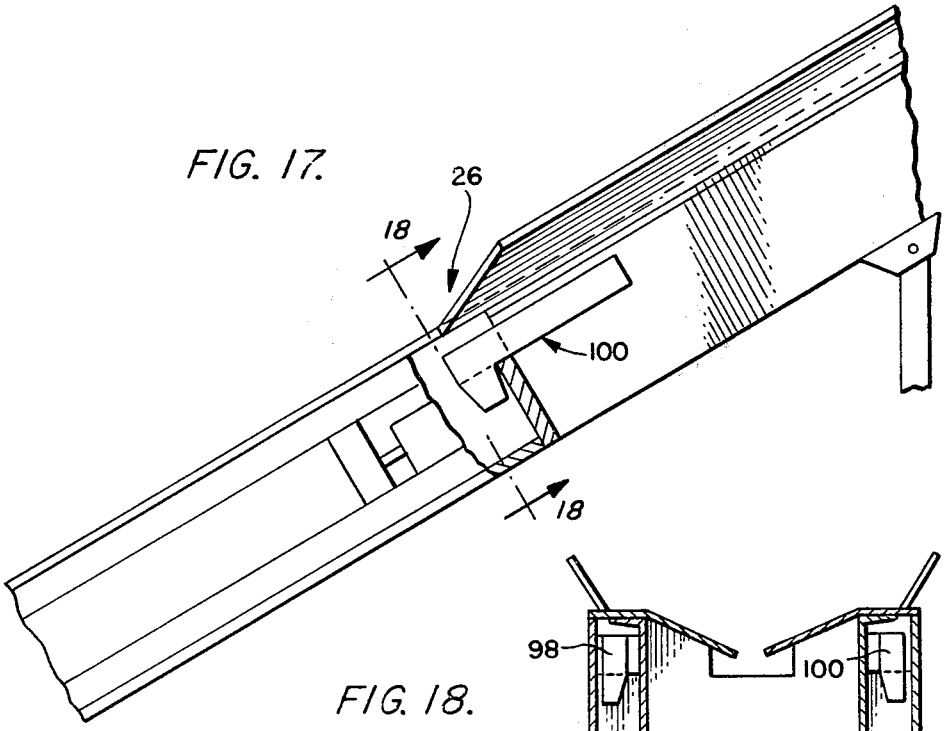
FIG. 17 is a side elevational view partly broken away of the apparatus of FIG. 16 illustrating the troughs and the locking means partly in cross-section.
Figure 18:
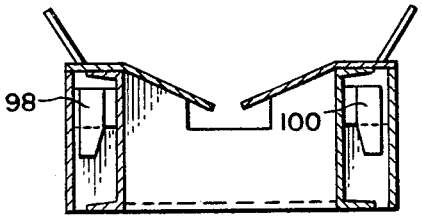
FIG. 18 is a cross-sectional view taken along line 18—18 in FIG. 17 to illustrate the detent means.

As best shown in FIG. 1, fixed trough 20 is inclined towards lift trough 14 and is supported at one end by drilling rig floor 22 and at the other end by fixed trough support 24. When lift trough 14 is in a fully inclined position, locking mechanism 26 connects it to fixed trough 20, as shown in FIG. 17. In this position, apron 50 can slide up the fixed trough and pipe loaded or unloaded from the apron onto the drilling rig. The trough dimensions of the fixed trough must thus be such that the apron may be fully supported thereby and may freely slide thereon.

Locking mechanism 26 includes a pair of downward extending detents in the form of hooks 98 and 100 at the end of the fixed trough 20 and a pair of upwardly disposed holding slots 102, 104 in the outer end of the lift trough 14. Thus, as the lift trough is lifted, hooks 98 and 100 are forced into slots 102 and 104. The hooks prevent the lift trough from moving up or from moving laterally relative to the fixed trough.

The fixed trough extends onto the drilling rig floor so that the tubulars may be then lifted onto the platform. With different tubular lengths and/or positioning of the drilling equipment on the platform it is often desirable to have the fixed trough extend an additional distance onto the platform. Preferably this adjustment should be made without requiring that the fixed trough be lifted and repositioned or without replacing it with a new fixed trough of different length. The present invention satisfies those criteria.

Figure 19A:
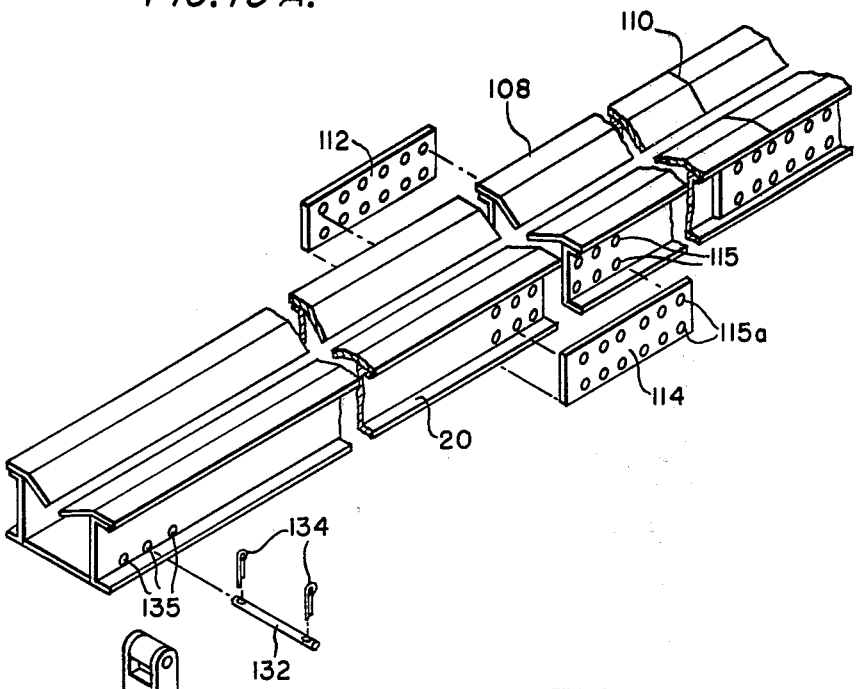
FIG. 19A is a perspective view partly broken away of the fixed trough of FIG. 1 with adjustable length segments illustrating the components thereof in exploded relation.

As is best illustrated in FIG. 19A additional trough segments 108 and 110 may be added to the uppermost end of fixed trough 20. A pair of plates 112 and 114 are fastened by bolts or other equivalent means to the sides of the fixed trough 20 and the trough segment 108. The plates must be of such length and strength as to overcome any moments created when pipe P and apron 56 are on the trough segment. As is shown in FIG. 19, as many segments may be added as needed limited only by the aforementioned moment created. Predrilled holes 115 can also be provided in the end of the fixed trough, the trough segments, and corresponding holes 115*a* provided in the plates, so that the fasteners and thus the segments may be added or removed with greater speed.

Figure 19B:
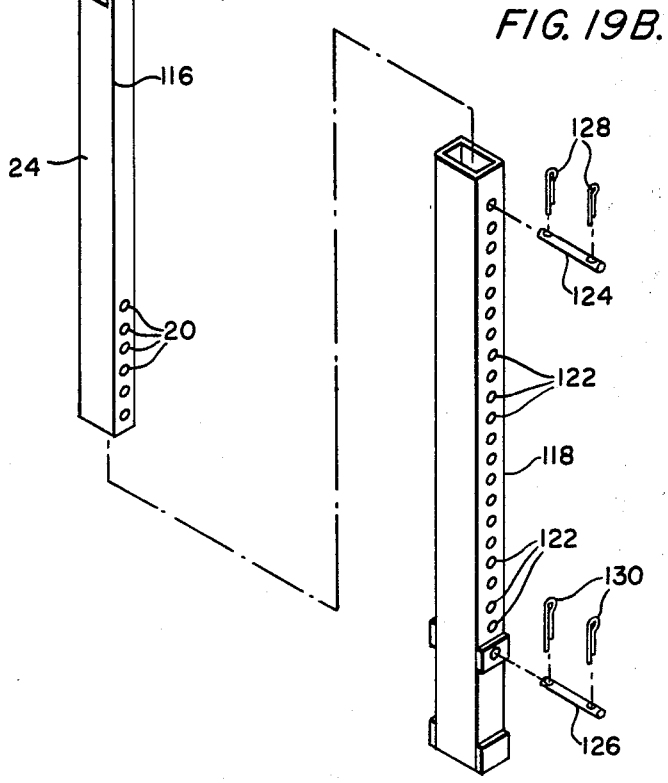
FIG. 19B is a perspective view of the support member for the fixed trough of FIG. 19B illustrating the components thereof in exploded relation.
Figure 21:
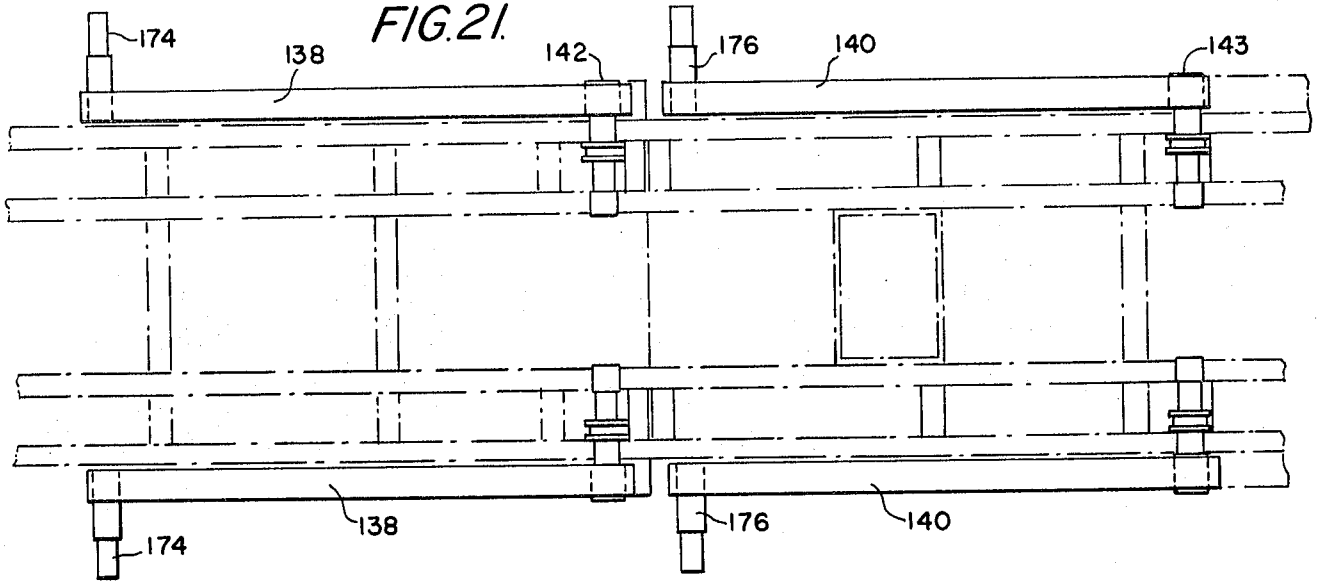
FIG. 21 is a top plan view partly broken away of the assembly of FIG. 20 partly in phantom lines.

Fixed trough support 24 is telescopic and adjustable to any desired length and includes upper leg 116 and lower leg 118 which are suitably sized to be disposed in telescoping relation, as best shown in FIG. 19B. Upper leg 116 is provided with holes 120 and lower segment 118 with holes 122. With leg segment 116 placed inside segment 118 and the desired length of fixed trough support 24 chosen, holes 120 and 122 are aligned and pins 124 and 126 inserted to secure support 24 at their length. Cotter pins 128 and 130 may then be placed through holes in the ends of pins 124 and 126 to hold the pins in place.

Fixed trough support 24 is pivotally connected to the lower end of fixed trough 20 by pin 132 inserted in a suitably spaced hole 135. Cotter pins 134 hold securing pin 132 in place. It is thus seen that the length of the fixed trough support may be adjusted whereby the angle of inclination of the fixed trough is adjusted so that it may properly align with lift trough 14. The bottom portion of leg segment 118 is attached to main frame 12 as shown in FIG. 2.

The pipe transfer system of this invention includes pipe transferring assemblies 16 and 18 positioned on the sides of catwalks 13, 13 and between pipe racks R. As shown in FIGS. 1 and 20–24, the pipe transferring assemblies include a pair of aligned arms 138 and 140 each located on the side of the pipe handling apparatus and next to one of the pipe racks R. The arm ends 138*a* and 140*a* are pivotally coupled to the frame at 142 and 143. Each pair of opposite arm ends 138*b* and 140*b* is connected to a tilt tray 144 for holding pipe and may move to an upper position above catwalk 13 and to a lower position below the catwalk as shown in FIGS. 1, 20, 22 and 26. In FIGS. 20 and 22 arms 138 and 140 are shown in phantom form in their upper positions.

A hydraulic system is employed for moving the arm ends 138*b* and 140*b* together to upward or downward positions or to any level in between. The hydraulic system comprises a pair of cylinders 145, 145 positioned horizontally and having their ends pivotally coupled to frame 10 at 146 and 148 at one end. At the other ends 150 and 152, the cylinders are pivotally coupled to arms 138 and 140 at 154 and 156 through use of ears 158 and 160 connected to arms 138 and 140 respectively at a location 161 in which the arms are enlarged to permit the cylinders 145, 145 to be horizontal at the lowest position of arms 138 and 140, thus permitting a lower reach of the tilting tray 144 without interference between the arms and cylinders.

FIG. 22 shows a slightly different embodiment of the invention of FIG. 20 primarily having the hydraulic cylinder attachments and arm shapes shown.

Figure 27:
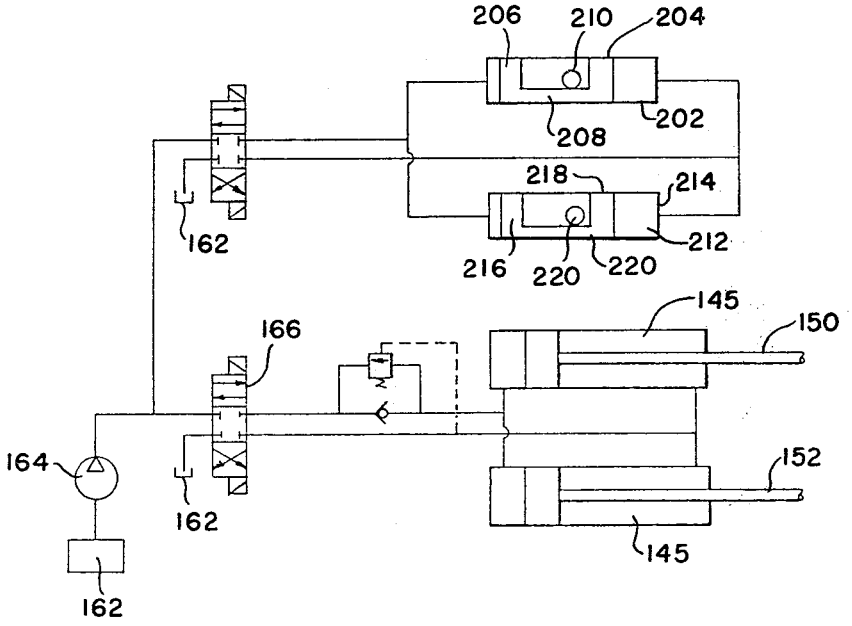
FIG. 27 is a schematic illustration of the hydraulic system for operating the pipe stacker assembly of FIGS. 20–26.

Referring to FIG. 27, the hydraulic system for operating cylinders 145, 145 comprises an oil reservoir 162, a pump 164, a four-way directional control valve 166 and appropriate flow lines.

Pivotally coupled to arm ends 138*b* and 140*b* is a tilt tray or trough 144 for carrying pipe P between rack R and pipe handling apparatus 10. Trough 144 can be tilted laterally in either direction to allow pipe P to be loaded or unloaded.

Referring to FIGS. 20–27, the mechanisms for coupling tilt tray 144 to arm ends 138*b* and 140*b* and for tilting tray 144 are shown. Tilting mechanisms shown generally at 170 and 172 are identical and are positioned at each end of arms 138, 140 for operating each tray 144. Arm ends 138*b* and 140*b* have stub shafts 174 and 176 rotatably secured at one end therein respectively allowing arms 138 and 140 to move up and down together carrying the length of tray 144 in a generally horizontal position.

Figure 23:
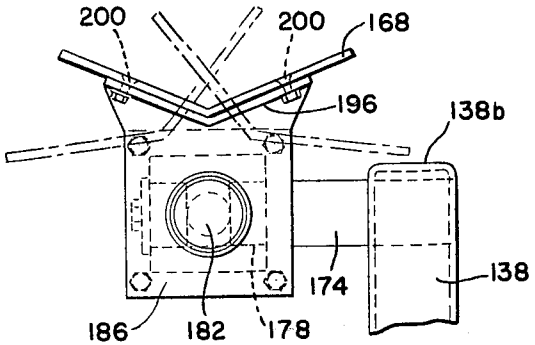
FIG. 23 is an enlarged end view partly broken away of the tilting mechanism of the stacker tray of FIGS. 20 and 22.

As best shown in FIG. 23, stub shaft 174 is rotatably secured at its other end in a suitable bore 178 formed through pivot block 180 which is pivotally mounted on shaft 182 positioned at right angles to shaft 174 and extending partially through pivot block 180. Dummy shaft 183 on pivot block 180 is pivotally received in plate 184. Plate 184 and 186 are mounted on shaft 182 for rotation by rotary actuator 190 secured to plate 184. Suitable bearings 192 and 194 are included to permit free pivoting of block 180. Plate 186, as best shown in FIG. 23, includes a V-shaped cradle 196 at its top. Tilt tray 144 is secured to the cradle formed by V-shaped portion 196 by bolts 200 or by equivalent means. Thus as rotary actuator 190 rotates plate 186 through shaft 182, tilt tray 144 tilts from one side to the other. Tilting mechanisms 170 and 172 are arranged in parallel fashion so that they work in tandem.

Rotary actuator 190 is a commercially available device and as shown in FIG. 27, it comprises a cylinder 202 having two pistons 204 and 206, with a rack 208 connected between the pistons. Rack 208 engages a pinion 210. Shaft 188 is an extension of pinion 210. When pressure is imposed on one side of the cylinder 202 it drives the piston and the rack in one direction to rotate pinion 210 and hence shaft 182. On the opposite side of the cylinder the pressure is released. In FIG. 27, member 212 is the cylinder for an identical rotary actuator 214 used in tilting mechanism 172. Cylinder 140 has two pistons 216 and 218 and a rack 220 connected between the pistons for rotating a pinion 220 from which extends a shaft similar to shaft 188. Both actuators of mechanisms 170 and 172 are operated simultaneously by hydraulic fluid from reservoir 162 and pump 164 for driving their shafts in the same direction for tilting the tray 144. Four-way valve 166 is employed for controlling the direction in which the two actuators 190 and 214 rotate their shafts and hence the direction in which tilt trough 144 is tilted.

Arms 138 and 140 and tilt tray 144 operate in the following manner to transfer pipe onto the rack R from the pipe handling apparatus 10. Assume that pipe is to be transferred from apparatus upwardly to the rack R on one side. Arms 138 and 140 of the pipe transferring assembly 18 are initially located such that tilt tray 144 will be just below catwalk 13 in non-tilted position. In this position, the upper edge of tray 144 is located close to catwalk 13 with very little space between the tray edge and catwalk 13 such that pipe P rolling outwardly on the catwalk will roll into the tray. The dump trough of the lift trough 14 is tilted laterally to dump the pipe onto the catwalk 13. From the catwalk, the pipe will roll into tilt tray 144. Cylinders 145, 145 are actuated to raise ams 138 and 140 and tray 144 with the tray held in a non-tilted, horizontal position. The tray thus will cradle and carry the pipe upward with no longitudinal movement of the pipe. Thus the pipe cannot roll off of the tray nor can it slide off of the tray longitudinally. When the tray 144 reaches the top of rack R, upward movement of arms 138 and 140 will be terminated and tray 144 will be tilted laterally in a direction to dump the length of pipe onto the top of rack R. Tray 144 will be moved to a non-tilted position and arms 138 and 140 and tray 144 moved downward to repeat the process.

For transferring pipe from rack R to pipe handling apparatus 10, arms 138 and 140 and tray 144 operate in the following manner. Assume that pipe P is to be transferred from an upper row of pipe on rack R to the pipe handling apparatus. Cylinders 145, 145 extend to move arms 138 and 140 such that tray 144 will be just below the top row of the pipe on the rack R with tray 144 on a non-tilted position whereby the V of the trough will be essentially straight up. A length of pipe P will be pushed into tray 144. Arms 138 and 140 will then be lowered simultaneously with tray 144 carrying the length of pipe downwardly in a horizontal position. When tray 144 reaches the level of catwalk 13, downward movement of arms 138 and 140 will be terminated and tray 144 will be tilted laterally in a direction to dump the length of pipe onto catwalk 13 where it will roll into the dump trough tilted to receive the pipe. Tray 144 will be moved to a non-tilted position and arms 138 and 140 and tray 144 moved upwardly to repeat the process. A pair of arms 138 and 140 and a laterally tiltable tray 144 as described above will be located on both sides of the apparatus in the form of the pipe transferring assemblies 16 and 18 between the racks and the apparatus.

Figure 28:
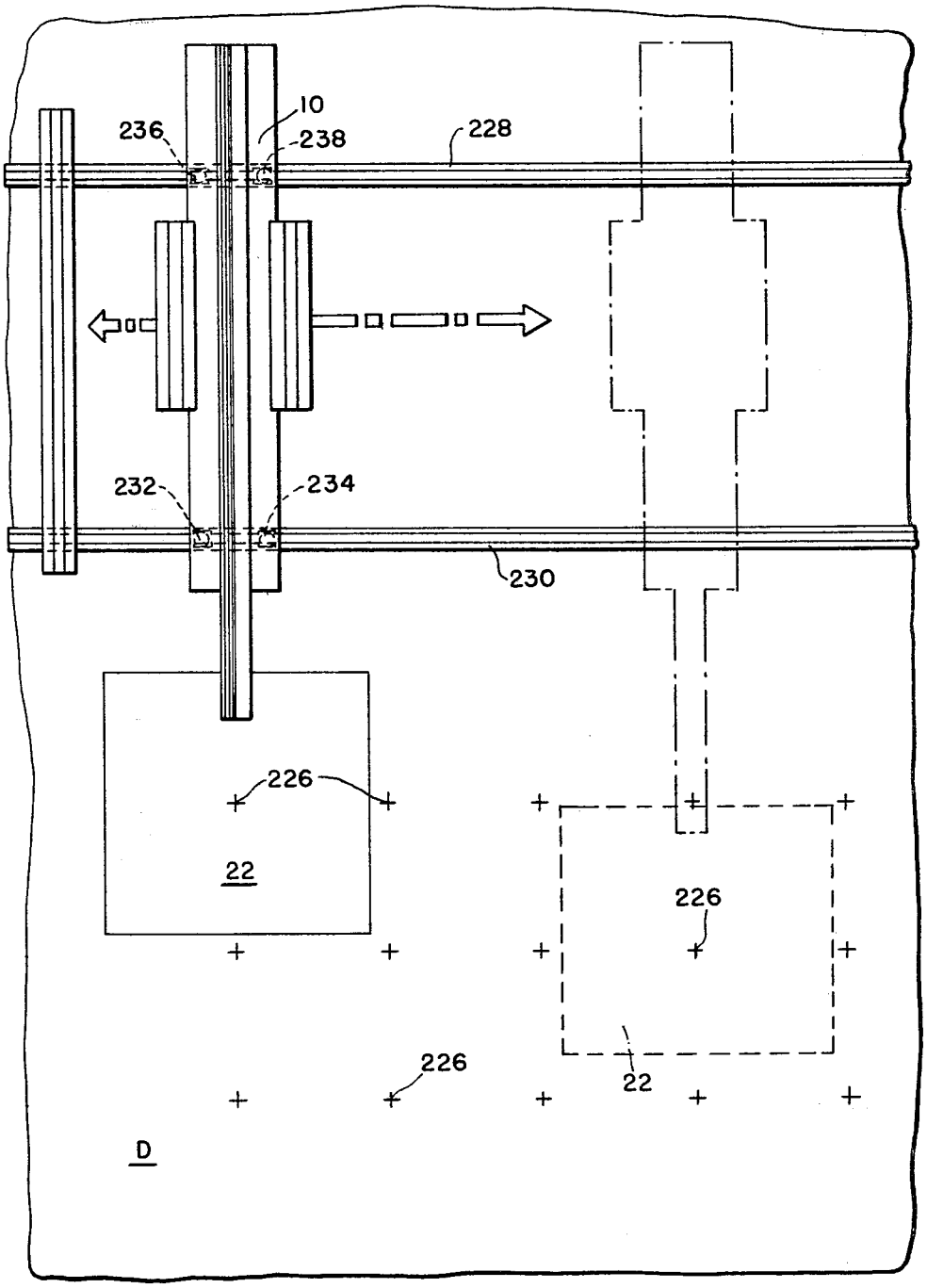
FIG. 28 is a top plan view of the apparatus of FIG. 1 positioned at a first location on a drilling rig and at another position in phantom lines and illustrating, partly broken away, the track system and surrounding drilling locations.
Figure 29:
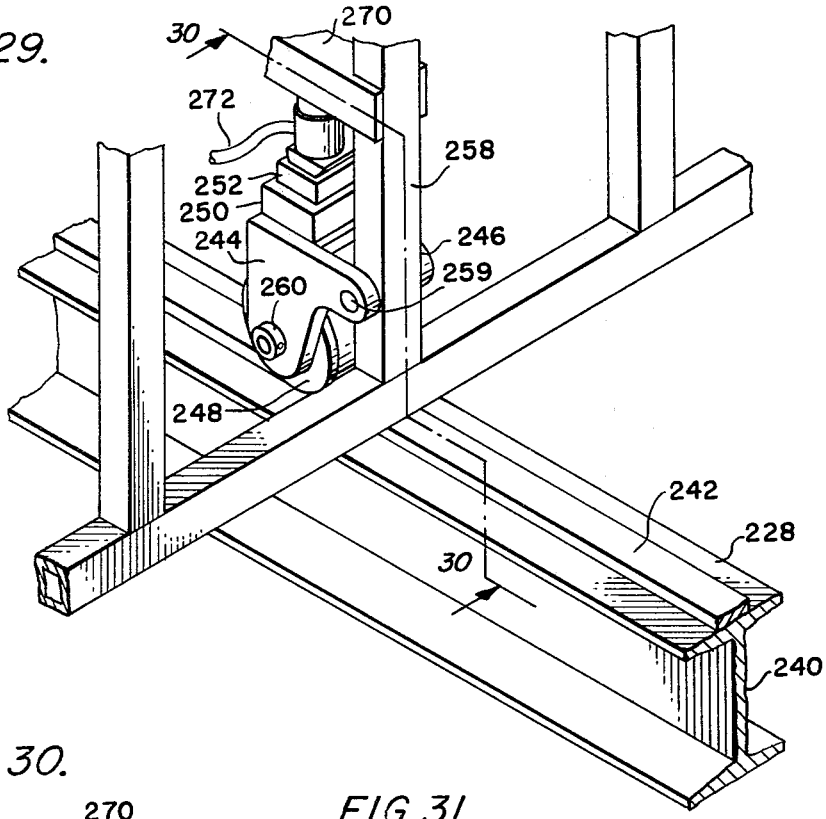
FIG. 29 is a perspective view partly broken away of the wheel assembly for the track system of FIGS. 1 and 28.

Referring to FIG. 28 there is shown a drilling rig platform D and rig floor 22, pipe handling apparatus 10 and drilling hole 226. It is often necessary to reposition apparatus 10 as shown so that it can be used at other hole sites and this invention provides a novel track and wheel assembly to accomplish this.

This track and wheel assembly is illustrated in FIGS. 28–31. It generally comprises two identical tracks 228 and 230 and four identical friction reducing means in the form or wheel assemblies 232, 234, 236 and 238 extending from the main frame. Track 228 includes an I-beam 240 of structural dimensions and material sufficient to support apparatus 10 for movement and a guide strip 242 centrally mounted on top of the beam 240.

Wheel assembly 232 includes a pair of L-shaped brackets 244 and 246, wheel 248, stabilizing platform 250, leveling pad or boss 252, hydraulic cylinder 254 and cylinder mounting frame 256.

Figure 30:
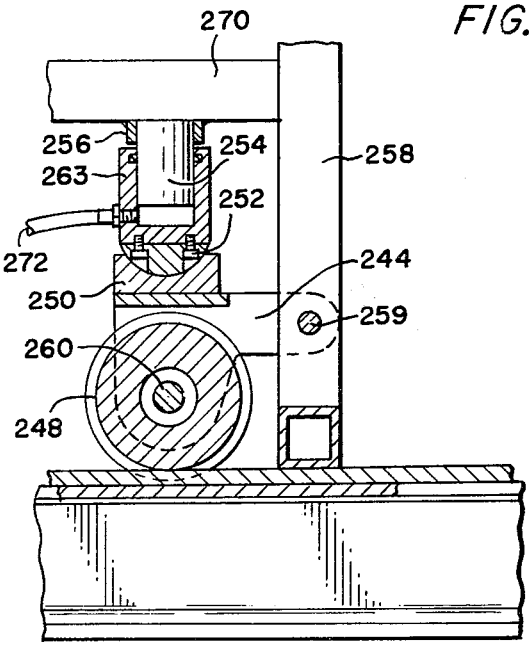
FIG. 30 is a cross-sectional view partly broken away taken along line 30—30 in FIG. 29.
Figure 31:
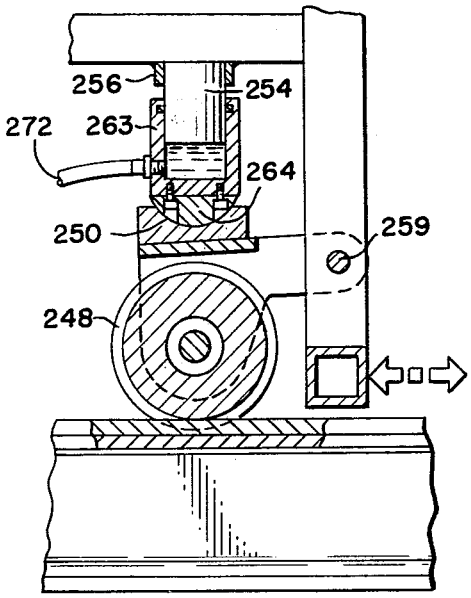
FIG. 31 is a view similar to that of FIG. 30 illustrating the apparatus in a lifted position and the wheel in rolling relation with the track.

Brackets 244 and 246 are positioned mutually parallel on opposite sides of the vertical member 258 of main support frame 12 and are pivotally connected thereto by shaft 259. Wheel 248 is positioned between the brackets 244 and 246 and is pivotally connected by shaft 260 at a point offset from shaft 259. Wheel 248 rolls on top of the top flange of I-beam 240 and its guide strip 242. Stabilizing platform 250 is mounted on top of the two brackets. As best shown in FIGS. 30 and 31 a depression 262 is formed on the upper surface of stabilizing platform 250. Leveling pad 252 is connected at the bottom of the housing 263 for cylinder 254. Cylinder support 256 is mounted to an underside surface of a horizontal member 270 of main support frame 12. Cylinder 254 is held vertically by means of support 256. As hydraulic fluid flows through line 272 hydraulic cylinder 254 bears against main support frame horizontal member 270 and through leveling pad 252 to stabilizing platform 250 to force the wheel 248 downwardly. Thus, as should be apparent from FIG. 31, support frame 10 is lifted above track 228 and wheel 248 is then in rolling relation with the track. Leveling pad 264 rocks in depression 262 as the brackets pivot thereby allowing the hydraulic cylinder to remain vertical. Pipe handling apparatus 10 may then be moved manually or by power means to the desired location.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, a driving means for driving said carriage means along said lift trough, said driving means including an endless chain means drivingly connected to said carriage means, an endless drive chain associated with said endless chain means, an endless drive chain driving means operatively connected to said endless drive chain means for driving said endless drive chain, and a transmitting means for transmitting drive from said endless drive chain to said endless chain means, said lift trough including a tiltable dump trough, a tilting means for tilting said dump trough laterally relative to said main support frame, and a releasable connecting means for connecting said carriage means to said driving means when said dump trough is in an untilted position relative to said lift trough, said releasable connecting means being in a disconnected position when said dump trough is in a tilted position.

2. The apparatus of claim 1 including, said transmitting means including a drive shaft, a drive sprocket mounted to said drive shaft at one end and operatively connected to said endless drive chain, and a driven sprocket mounted to said drive shaft at a second end thereof and operatively connected to said endless chain means.

3. The apparatus of claim 1 including, said carriage means including a generally vertically disposed member and a protecting means connected to said vertically disposed member for protecting the tubular as it impacts said vertically disposed member.

4. The apparatus of claim 3 including, said protecting means comprising a resilient material attached to said vertically disposed member on a tubular contact surface of said vertically disposed member.

5. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, said carriage means including a movable holding tray adapted to receive and hold said tubulars for movement along said lift trough between said rig and said rack, a carriage connected to said movable holding tray to prevent said tubulars from sliding down said elongated structural member when said lift trough is in an inclined position, said carriage means further including a generally vertically disposed member and a protecting means connected to said vertically disposed member for protecting the tubular as it impacts said vertically disposed member, a portion of said lift trough being a dump trough supported by said main support frame, a tilting means for tilting said dump trough laterally relative to said main support frame when said lift trough is in said generally horizontal position, and a tilt connecting means positioned between said movable holding tray and said dump trough for allowing said dump trough to tilt with said movable holding tray.

6. The apparatus of claim 5 including, said protecting means comprising a resilient material attached to said vertically disposed member on a tubular contact surface.

7. The apparatus of claim 5 including, an endless chain means drivingly connected to said carriage means, an endless drive chain associated with said endless chain means, an endless drive chain driving means operatively connected to said endless drive chain means for driving said endless drive chain, and a transmitting means for transmitting drive from said endless drive chain to said endless chain means.

8. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, and a transferring means for transferring lengths of pipe laterally between said pipe rack and said main support frame, said pipe rack being located to one side of said main support frame, said transferring means comprising at least two spaced apart pivotally supported arms located on said one side of said frame adjacent to said pipe rack, each said arm having one end pivotally coupled to said main support frame and an opposite end adapted for movement upwardly and downwardly, a tray means capable of supporting a length of tubular pivotally coupled to said arms at said opposite ends such that said tray means will move upwardly and downwardly with said opposite ends of said arms, a tilting means for tilting said tray means laterally in opposite directions, an arm moving means for moving said arms about their pivot axes respectively and for moving said opposite ends of said arms and said tray means upwardly and downwardly in a generally horizontal fashion, said tilting means including at least one rotating member operatively connected to said tray means for rotating said tilting tray means, said rotating member having a rotating axis about which said tilting tray means rotates.

9. The apparatus of claim 8 including, said rotating member supporting said tray means.

10. The apparatus of claim 8 including, said rotating member being longitudinally disposed and generally parallel to the longitudinal axis of said tray means.

11. The apparatus of claim 8 including, said rotating member connecting at least in part said tray means to said arms.

12. The apparatus of claim 8 including, said tray means including a pipe support tray and at least one depending member depending from and mounted to said pipe support tray, and said depending member being secured to said rotating member so that when said rotating member rotates said tilting tray means rotates about said rotating axis of said rotating member.

13. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, a fixed trough supported from said drilling rig floor in a downwardly sloping position whereby one end extends downwardly away from said rig and toward said main support frame to engage the upper end of said lift trough when said lift trough is in the fully inclined position to provide a continuous path for said tubulars, a supporting means connected to the downwardly inclined end of said fixed trough remote from said rig for supporting said downwardly inclined end, a height adjusting means for adjusting the height of said supporting means, an angle adjusting means associated with said height adjusting means for adjusting the angle of connection between said supporting means and said fixed trough, said drilling rig and said main support frame being supported on a drilling rig platform, and an apparatus moving means connected to said main support frame for moving said main support frame on said drilling rig platform relative to said drilling rig floor.

14. The apparatus of claim 13 including, a length adjusting means for adjusting the length of said fixed trough.

15. The apparatus of claim 13 including, said height adjusting means including upper and lower legs in telescoping relation, a plurality of vertically arranged holes in each said leg, said holes being spaced for mutual registration, at least one pin extending through a pair of registered holes in both of said legs to secure said legs at the desired telescopic length and a connecting means for connecting said upper leg to the downward end of said fixed trough.

16. The apparatus of claim 13 including, said supporting means being connected to said support frame, said carriage means being dimensioned to support both ends of the tubular, and said fixed trough being adapted to slideably receive said carriage means.

17. The apparatus of claim 13 including, a pivotal connecting means for pivotally connecting said fixed trough to said drilling rig floor.

18. The apparatus of claim 13 including, a releasable holding means for releasably holding said pivotal trough and said fixed trough together, said releasable holding means including at least one detent means positioned on said fixed trough, said detent means including at least one downwardly directed hook attached to the end of the fixed trough remote from said rig and engageable with the upper end of said lift trough, and said holding means including a receiving means positioned on said lift trough to cooperatively receive said detent means.

19. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, said drilling rig and said main support frame being supported on a drilling rig platform, and an apparatus moving means connected to said main support frame for moving said main support frame on said drilling rig platform relative to said drilling rig floor.

20. The apparatus of claim 19 including, said apparatus moving means including at least one track positioned beneath said apparatus and oriented in the direction of desired movement of said main support frame and at least one friction reducing means attached to said main support frame and in contact with said track to permit said movement.

21. The apparatus of claim 20 including, a height controlling means for selectively varying the height of said main support frame relative to said track between active and inactive positions whereby said main support frame may be moved along said track.

22. The apparatus of claim 21 including, said height controlling means including a power means for urging said friction reducing means toward said track.

23. The apparatus of claim 20 including, said friction reducing means including at least one wheel assembly.

24. The apparatus of claim 23 including, said wheel assembly including a wheel adapted to ride on said track, a wheel support means including a bracket member pivotally attached at one end to said main support frame and at the other end supporting said wheel for rotation along said track.

25. The apparatus of claim 24 including, said wheel support means including a stabilizing means to receive said height controlling means.

26. The apparatus of claim 25 including, said height controlling means including a hydraulic cylinder positioned between said main support frame and said stabilizing means whereby when said hydraulic cylinder assembly is extended said bracket member is pivoted downwardly causing said main support frame to lift and said wheel to engage said track.

27. The apparatus of claim 24 including, said wheel support means further including a stabilizing means to receive said height controlling means, said stabilizing means being secured to said bracket member.

28. The apparatus of claim 27 including, said height controlling means including a power means positioned between said main support frame and said stabilizing means, a housing for said power means and a boss on said housing for being received by said stabilizing means to permit said bracket member to rock relative to said height controlling means as said power means is extended.

29. The apparatus of claim 19 including, a drilling rig moving means operatively connected to said drilling rig for moving said drilling rig on said drilling rig platform, and said drilling rig moving means being generally separate from said apparatus moving means.

30. The apparatus of claim 19 including, a fixed trough supported from said drilling rig floor in a downwardly sloping position whereby one end extends downwardly away from said rig and toward said main support frame to engage the upper end of said lift trough when said lift trough is in the fully inclined position to provide a continuous path for said tubulars.

31. The apparatus of claim 30 including, an extension means attached to said fixed trough for extending the length of said fixed trough further onto said drilling rig floor.

32. The apparatus of claim 31 including, said extension means including at least one fixed trough segment suitably dimensioned to connect to said fixed trough to form a continuous fixed trough and a securing means for connecting said segment to the upper end of said fixed trough, and said securing means including at least one plate extending between said fixed trough segment and said fixed trough and fastened to the sides thereof.

33. The apparatus of claim 19 including, a releasable holding means for releasably holding said pivotal trough and said fixed trough together when said lift trough is in said inclined position, said releasable holding means including at least one detent means positioned on said fixed trough, said detent means including at least one downwardly directed hook attached to the end of the fixed trough remote from said rig and engageable with the upper end of said lift trough, and said holding means including a receiving means positioned on said lift trough to cooperatively receive said detent means.

34. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, said lift trough having an upper surface, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, said carriage means including a movable holding tray adapted to receive and hold said tubulars for movement along said lift trough between said rig and said rack, said movable holding tray being adapted for sliding movement along said upper surface, said carriage means further including a carriage connectable to said movable holding tray, said carriage preventing the tubular held by said carriage means from sliding longitudinally out of said movable holding tray when said lift trough is in said inclined position, an adjustable connecting means for connecting said carriage to said movable holding tray at different locations along said movable holding tray to accommodate different lengths of tubulars on said movable holding tray, said adjustable connecting means including a handle attached to said carriage and adapted to be grasped by the hand of a user whereby by grasping said handle said carriage can be lifted off of said movable holding tray and repositioned on said movable holding tray, said adjustable connecting means including a protruding member mounted on said carriage and a removable mounting means for removably mounting said protruding member to said movable holding tray, said removable mounting means including an actuating means for actuating said removable mounting means, said actuating means being positioned so that it may be actuated by the thumb of the hand of the user who is grasping said handle, and said removable mounting means including a plurality of openings spaced longitudinally along said movable holding tray and each said opening being adapted to receive said protruding member therethrough.

35. The apparatus of claim 34 including, said adjustable connecting means including a detent means attached to said carriage.

36. The apparatus of claim 34 including, said handle being disposed in a vertical plane positioned parallel to a longitudinal axis of said lift trough when said carriage is positioned in said lift trough and said actuating member being vertically positioned in said vertical plane and adjacent said handle, said carriage having a vertical stop member, and said handle and said actuating means being positioned behind said vertical stop member.

37. The apparatus of claim 34 including, said movable holding tray being dimensioned to support the entire length of said tubular.

38. The apparatus of claim 34 including, a friction reducing means positioned underneath said movable holding tray.

39. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, a transferring means for transferring lengths of pipe laterally between said pipe rack and said main support frame, said pipe rack being located to one side of said main support frame, said transferring means comprising a plurality of spaced apart pivotally supported arms located on said one side of said frame adjacent to said pipe rack, each arm having one end pivotally coupled to said main support frame and an opposite end adapted for movement upwardly and downwardly, a tray means capable of supporting a length of a tubular pivotally coupled to said arms at said opposite ends such that said tray means will move upwardly and downwardly with said opposite ends of said arms, a tray tilting means for tilting said tray means laterally in opposite directions, an arm moving means for moving said arms about their pivot axes respectively and for moving said opposite ends of said arms and said tray means upwardly and downwardly in a generally horizontal fashion, and said tray tilting means including at least one tilting assembly, each said tilting assembly including a rotary actuator, an actuator arm operatively connected to said rotary actuator and disposed parallel to the axis of said tray means, at least one block attached to said tray means and rotatably receiving said actuator arm whereby when said actuator rotates said arm said pivot block is rotated and said tray means is tilted.

40. An apparatus for transferring tubulars between the floor of a drilling rig and a pipe rack comprising, an elongated main support frame adapted to be positioned in proximity to said pipe rack, a lift trough positioned longitudinally of said support frame and having one end pivotally coupled to said main support frame, whereby said lift trough can be pivoted upwardly to an inclined position, a power means connected to said lift trough for pivoting said lift trough upwardly to an inclined position relative to said main support frame and toward said drilling rig and downwardly to a generally horizontal position, a carriage means operatively connected to said lift trough for moving tubulars positioned in said lift trough along its length, a fixed trough supported from said drilling rig floor in a downwardly sloping position whereby one end extends downwardly away from said rig and toward said main support frame to engage the upper end of said lift trough when said lift trough is in the fully inclined position to provide a continuous path for said tubulars, a supporting means connected to the downwardly inclined end of said fixed trough remote from said rig for supporting said downwardly inclined end, said supporting means being connected to said support frame, a pivotal connecting means for pivotally connecting said fixed trough to said drilling rig floor, said supporting means including a height adjusting means for adjusting the height of said supporting means, said height adjusting means including upper and lower legs in telescoping relation, a plurality of vertically arranged holes in each said leg, said holes being spaced for mutual registration, at least one pin extending through a pair of registered holes in both of said legs to secure said legs at the desired telescopic length and a connecting means for connecting said upper leg to the downward end of said fixed trough, and an angle adjusting means associated with said height adjusting means for adjusting the angle of connection between said supporting means and said fixed trough.

41. The apparatus of claim 40 including, a length adjusting means for adjusting the length of said fixed trough, said angle adjusting means including a second pin means passing through an upper portion of said supporting means and passing through the lower end of said fixed trough.

42. The apparatus of claim 40 including, said carriage means being dimensioned to support both ends of the tubular, and said fixed trough being adapted to slideably receive said carriage means.

43. The apparatus of claim 40 including, a releasable holding means for releasably holding said pivotal trough and said fixed trough together, said releasable holding means including at least one detent means positioned on said fixed trough, said detent means including at least one downwardly directed hook attached to the end of the fixed trough remote from said rig and engageable with the upper end of said lift trough, and said holding means including a receiving means positioned on said lift trough to cooperatively receive said detent means.

* * * * *